United States Patent [19]

Howard

[11] 4,153,221

[45] May 8, 1979

[54] ROLLING DOOR CURTAIN MOUNTING APPARATUS

[76] Inventor: Douglas Howard, 10256 S. Choctaw, Baton Rouge, La. 70815

[21] Appl. No.: 801,736

[22] Filed: May 31, 1977

[51] Int. Cl.[2] ..... B65H 17/02; B65H 75/40

[52] U.S. Cl. ..... 242/86.52; 242/67.3 R; 242/68.7

[58] Field of Search ..... 242/86.52, 86.5 R, 85, 242/67.3 R, 68.7, 78.7, 55, 67.1 R

[56] References Cited

U.S. PATENT DOCUMENTS

| | | | |
|---|---|---|---|
| 2,656,050 | 10/1953 | Best et al. | 242/68.7 |
| 3,203,638 | 8/1965 | Theodosiou | 242/68.4 X |
| 3,325,120 | 6/1967 | Brinkman | 242/86.52 |
| 3,408,018 | 10/1968 | Best | 242/68.7 X |
| 3,501,109 | 3/1970 | Edson | 242/86.52 |
| 3,889,831 | 6/1975 | Davis | 242/68.7 X |

*Primary Examiner*—Harvey C. Hornsby
*Assistant Examiner*—John M. Jillions
*Attorney, Agent, or Firm*—Roy, Kiesel, Patterson & Abadie

[57] ABSTRACT

An apparatus for mounting a rolling door curtain on a barrel assembly, which will be attached in position about an opening that the rolling door curtain will close, is disclosed comprising a movable carrier having drive means attached thereto in one position with rolling door curtain support braces attached to the movable carrier below the drive means wherein the barrel assembly is removably attached to the drive means and rotatably attached to the movable carrier.

2 Claims, 8 Drawing Figures

ROLLING DOOR CURTAIN MOUNTING APPARATUS

BACKGROUND OF THE INVENTION

1. Field of the Invention

This invention relates generally to rolling doors, and more particularly to apparatus for mounting a rolling door curtain on a barrel assembly.

2. Prior Art

Presently rolling door curtains are constructed principally from metal strips hingedly connected together, although they can also be constructed from wood or other materials. Typically, the rolling door curtains are shipped from the manufacturer to the installer in a rolled up bundle. In most instances, there will be cardboard or other protective material between each roll in the bundle to protect the rolling door curtain from being bent or damaged in shippage. The size of the bundle can vary depending upon the size of the rolling door curtain, but, generally, the rolling door curtain is between eight (8) to fifteen (15) feet wide and eight (8) to twenty (20) feet long.

The present practice to install the rolling door curtain is first to unroll the bundle out over a flat surface on the ground, such as a concrete driveway, then attach the rolling door curtain to a barrel assembly, wind the rolling door curtain on the barrel assembly while it is on the ground, and finally to lift the barrel assembly with wound rolling door curtain in position to be permanently attached.

An alternate present practice is to first attach the barrel assembly in position, then unwind and lift the rolling door curtain to the barrel assembly for attachment, and finally wind the rolling door curtain about the barrel assembly.

In either of the present techniques, multiple problems occur, some of which include: damage to the rolling door curtain when it is laid out on the ground, requirement of a large area to wind the rolling door curtain, difficulty in attaching the rolling door curtain to the pre-hung barrel assembly and the time required to attach and position the rolling door curtain.

SUMMARY OF THE INVENTION

Therefore, it is an object of this invention to provide an apparatus for mounting a rolling door curtain on a barrel assembly which reduces or eliminates the damage to the rolling door curtain.

Another object of this invention is to provide an apparatus for mounting a rolling door curtain on a barrel assembly in a small area.

Still another object of this invention is to provide an apparatus for easily mounting a rolling door curtain on a barrel assembly.

A still further object of this invention is to provide an apparatus for quickly mounting a rolling door curtain on a barrel assembly.

Other objects and advantages of this invention will become apparent from the ensuing descriptions of the invention.

Accordingly, an apparatus for mounting a rolling door curtain on a barrel assembly which will be attached about a door opening for closing same which comprises a movable carrier having adjustably, parallel, spaced apart vertical members, rolling door curtain support braces attached to the carrier below a position where the barrel assembly attaches, and a drive means attachable to the movable carrier at a position above the support braces wherein the drive means is removably attachable to the barrel assembly.

PREFERRED EMBODIMENTS OF THE INVENTION

Figure 1:
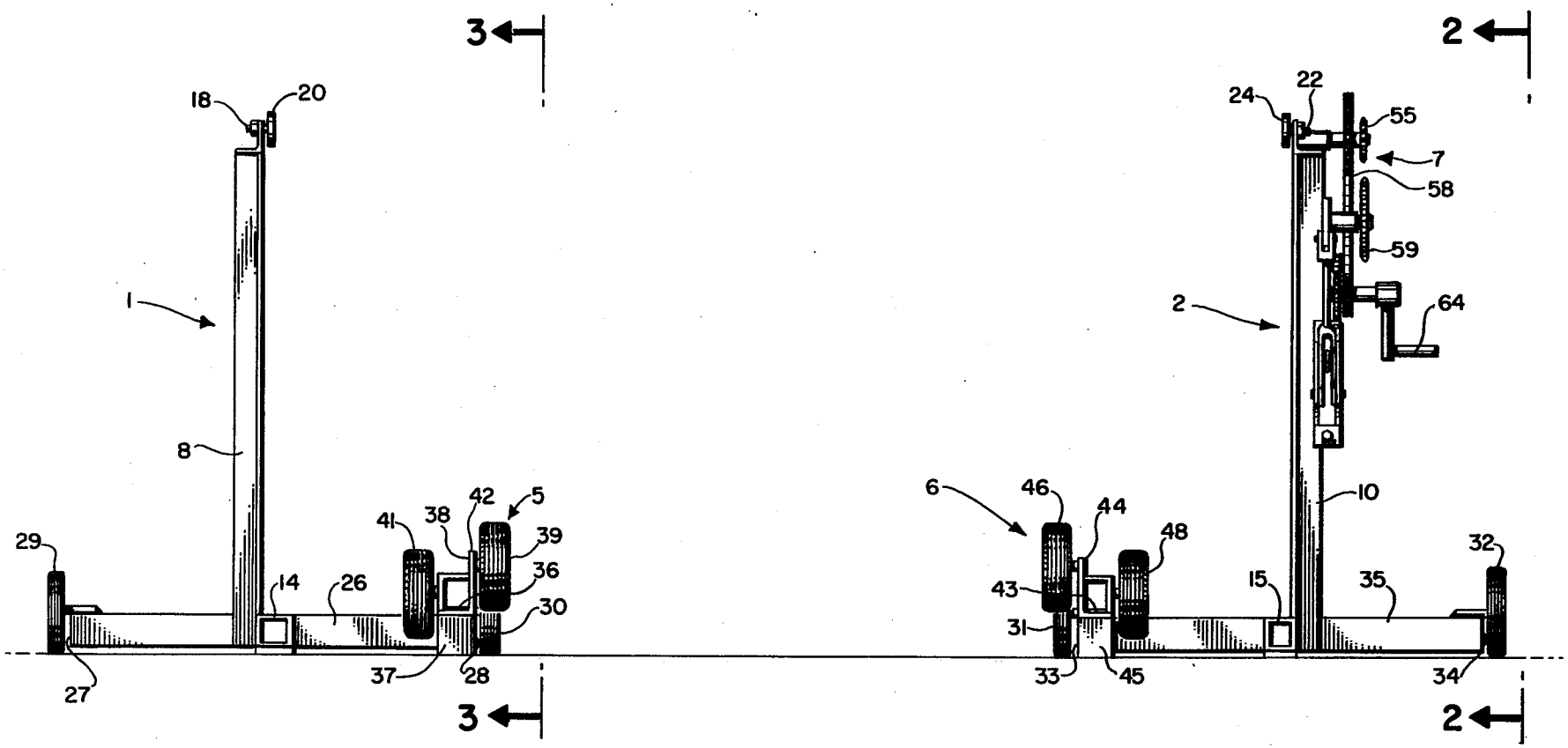
FIG. 1 is a frontal perspective view of one embodiment of this invention.

The rolling door curtain mounting apparatus comprises, in general, movable carriers 1 and 2, each having a vertical support member 3 and 4, respectively, perpendicularly attached to rolling door curtain support brace assemblies 5 and 6, respectively, and a drive means 7 attached to vertical support member 4.

Figure 2:
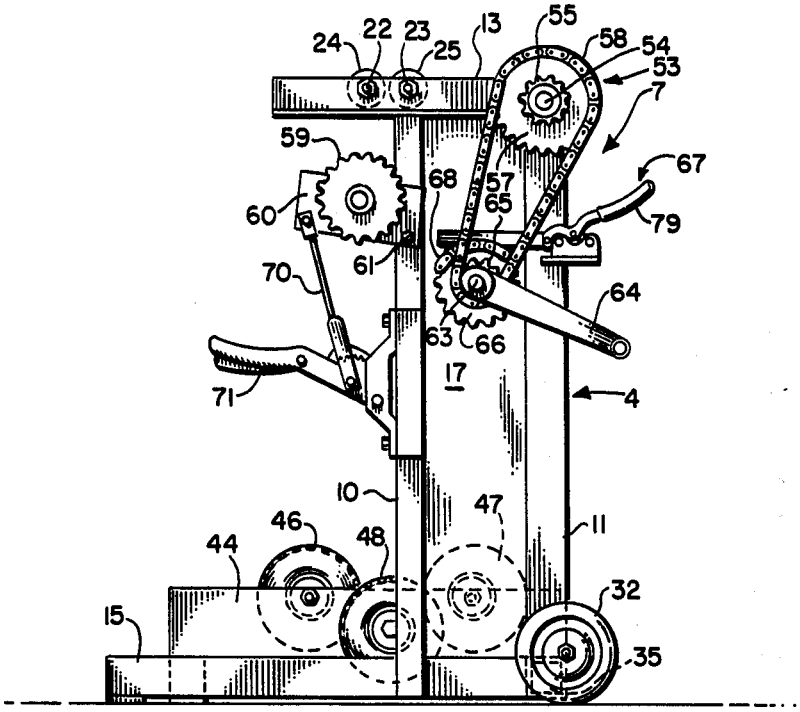
FIG. 2 is a perspective view taken along lines 2—2 of FIG. 1.
Figure 3:
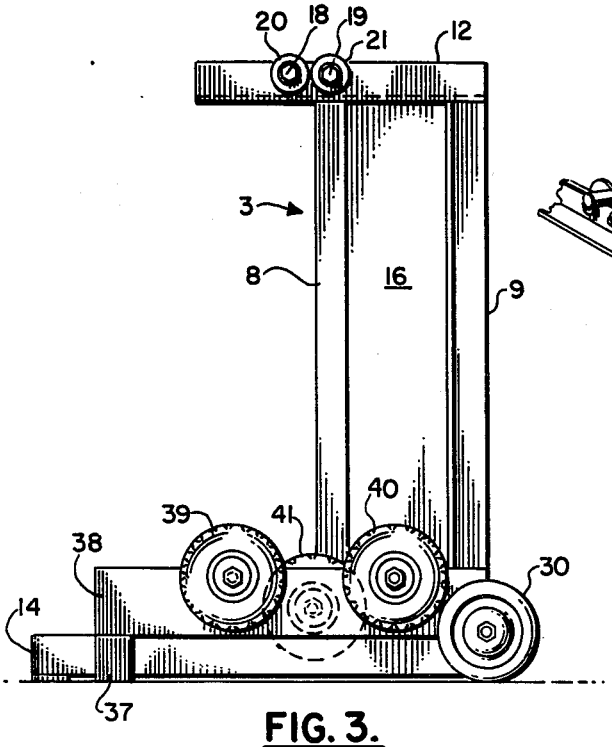
FIG. 3 is a perspective view taken along lines 3—3 of FIG. 1.

Each vertical support member 3 and 4 preferably is constructed from two vertical parallel pieces of angle iron 8, 9 and 10, 11, respectively, connected together at the top by horizontal angle iron braces 12 and 13, respectively, and at the bottom by horizontal tubular braces 14 and 15, respectively. In a more preferred embodiment, metal plates 16 and 17 are welded between angle iron 8, 9 and 10, 11, respectively, (see FIGS. 2 and 3).

Attached to brace 12 by bolts 18 and 19 are parallel rollers 20 and 21, respectively, which partially extend above brace 12 and which can rotate about bolts 18 and 19. Similarly, bolts 22 and 23 rotatably attach rollers 24 and 25, respectively, to brace 13.

Perpendicularly attached at the bottom of vertical support member 3 and also being perpendicular to brace 14 is cross tubing 26. At either tubing end 27 and 28 are rotatably mounted wheels 29 and 30, respectively, whereby a portion of each wheel 29, 30 extends below cross tubing 26. In similar fashion, wheels 31, 32 are rotatably mounted to ends 33, 34 of cross tubing 35 attached to vertical support member 4.

Rolling door curtain support brace assembly 5 comprises in a preferred embodiment angle iron 36 attached at one end to cross tubing 26 and which extends parallel to tubing 14. In a more preferred feature, leveling block 37 is attached to the opposite end of angle iron 36 and which has a height the same as cross tubing 26. Rotatably attached to wall 38 of angle iron 36 are wheels 39, 40 and 41. Preferably, wheels 39 and 40 will be spaced apart and level with one another with a portion of each extending above edge 42 of wall 38. Wheel 41 will be positioned on the other side of wall 38 and slightly below wheels 39 and 40 but with a portion extending above edge 42. Likewise, rolling door curtain support brace assembly comprises angle iron 43 having side wall 44 and attached at one end to cross tubing 35, leveling block 45 attached to the opposite end, wheels 46, 47 and 48 all assembled together like their counterparts in rolling door curtain support brace assembly 5.

Figure 7:
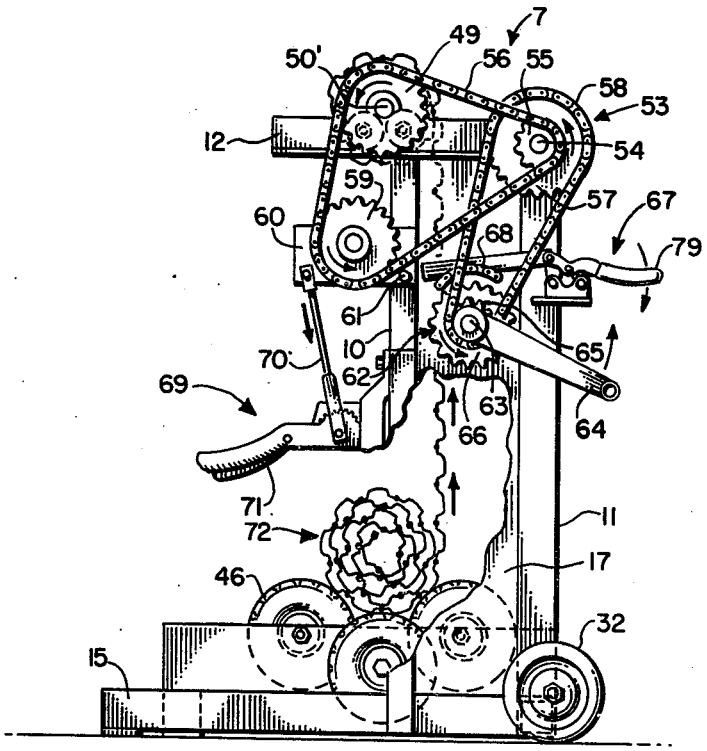
FIG. 7 is a perspective view taken along lines 7—7 of FIG. 6.
Figure 6:
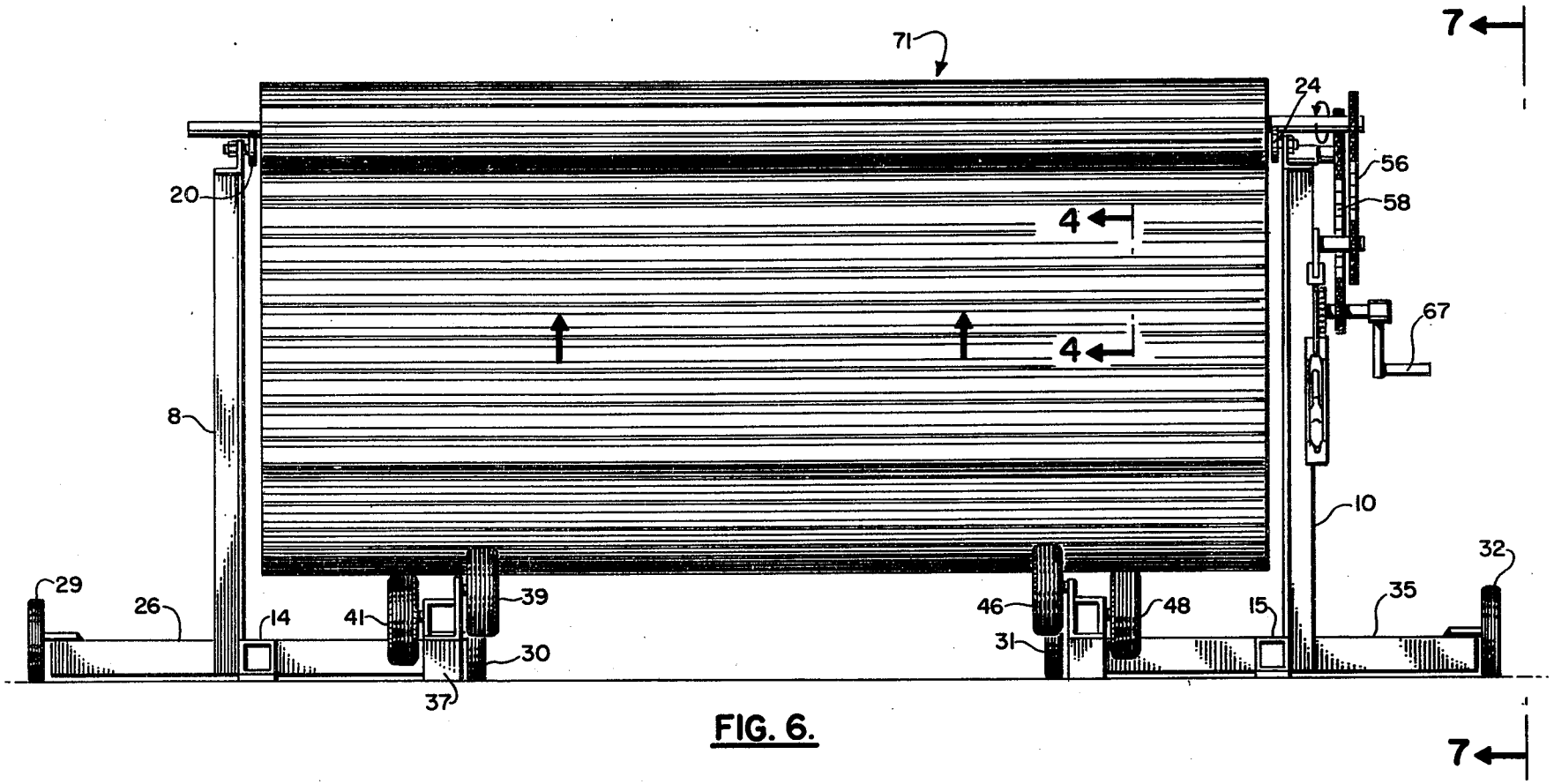
FIG. 6 is a perspective view of one embodiment of this invention illustrating a partially mounted rolling door curtain on this barrel assembly.

Examining FIG. 7, one embodiment of drive means 7 is illustrated. In this case, sprocket 49 is attached by screw 50 to shaft 50' of barrel 51 of barrel assembly 52. A double sprocket 53 is mounted on shaft 54 attached to the upper portion of angle iron 11 having a smaller radius toothed disc 55 to receive chain 56 which also fits over sprocket 49 and having a larger radius toothed disc 57 to receive a second chain 58. A third sprocket 59 is attached to metal brace 60 pivotedly attached to angle iron 10 below sprocket 49 by bolt 61. Chain 56 also fits about sprocket 59. Finally, a fourth sprocket 62 is attached to plate 17 by axle 63 at a position below the other sprockets to receive chain 58. Also attached to axle 63 is crank 64. In a preferred embodiment, sprocket 62 will have two different radii teethed discs 65 and 66 to one of which chain 58 will be attached, depending on the gear ratio desired. In another preferred embodiment, locking assembly 67 is attached to angle iron 11 in position to have locking means such as chain piece 68 engage disc 66 and prevent its rotation. In another preferred embodiment, clutch assembly 69 comprising attaching rod 70 and engaging means 71 is attached at one part to angle iron 10 and with attaching rod 70 attached to metal brace 60 to lock sprocket 59 in position to tighten chain 56.

Figure 5:
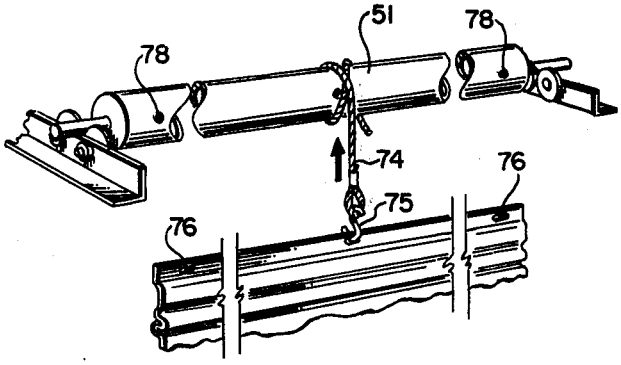
FIGS. 5 and 5A are exploded perspective views of one embodiment of this invention illustrating the attachment of the rolling door curtain to the barrel assembly.
Figure 5A:
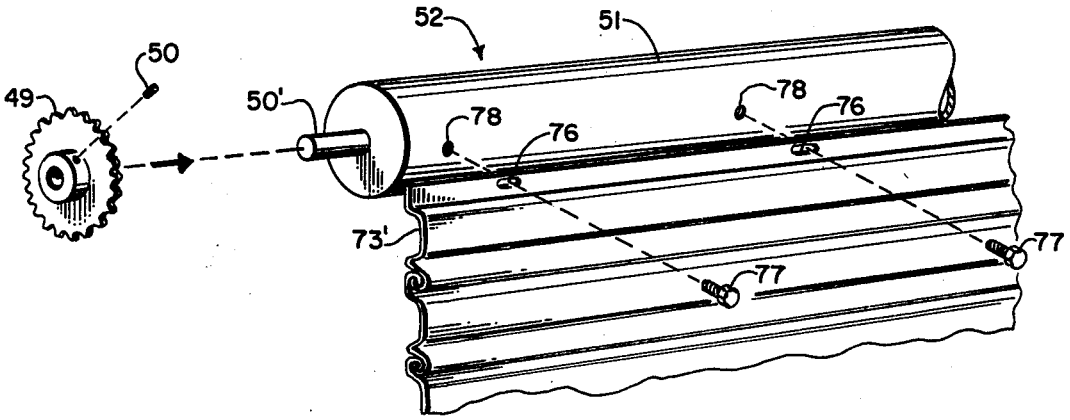
Figure 4:
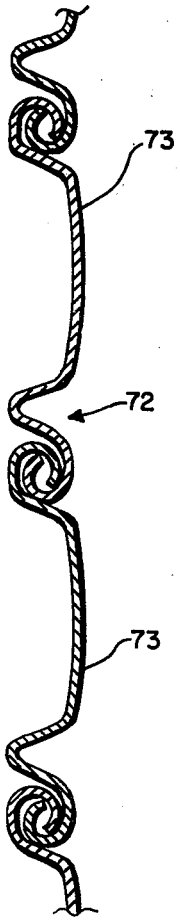
FIG. 4 is a cross-section view taken along lines 4—4 of FIG. 6.

FIG. 4 illustrates a typical cross-section of a rolling door curtain 72 which comprises multiple similar sections 72 pivotedly hinged together as shown. In operation, rolling door curtain 72, which is received from the manufacturer in a rolled up form, is placed on wheels 39, 40, 41, 46, 47 and 48 as illustrated in FIG. 7. Next as illustrated in FIGS. 5 and 5A, ropes 74 are attached at one end by S-hooks 75 to curtain openings 76 of section 73'. Ropes 74 are then wrapped around barrel 51 which has been placed on rollers 20, 21, 24 and 25 as shown. Curtain 72 is then lifted up to barrel 51 where it is temporarily secured to angle iron 8 and 10 by vise grips or other similar means. Ropes 74 are then removed and curtain 72 is secured to barrel 51 by screws 77 which pass through curtain openings 76 and into threaded receiving members 78 attached to barrel 51. Sprocket 49 is then attached to shaft 50' and chain 56 is tightened by clutch assembly 69. Finally, rolling door curtain 72 is rolled up on barrel assembly 52 by turning handle 64 in the direction shown. If necessary, locking assembly 67 can be engaged by pushing handle 78 up and forcing chain piece 68 against disc 66 to secure barrel assembly 52, while any adjustments to rolling door curtain 72 are made. Once rolling door curtain 72 is completely rolled up on barrel assembly 52, it can be hung in position at the building site.

There are, of course, many alternate embodiments, such as use of a motorized drive means, etc., and no limitation is intended by the above description of the preferred embodiments.

What I claim is:

1. An apparatus for mounting a rolling door curtain on a barrel assembly which will be attached in position about an opening that said door can close, which comprises:

(a) movable carriers having parallel spaced apart vertical members, each of said vertical members having a pair of spaced apart rollers rotatably connected thereto on which a shaft of said barrel assembly rests and between said rollers, each of said vertical members being perpendicularly attached to a base member supported on wheels; and (b) rolling door curtain support brace assembly attached to each of said movable carriers below a position where said barrel assembly is attached, said rolling door curtain support brace assembly comprising second pairs of spaced apart rollers rotatably attached to said base members, each of said second pairs is attached to one of said base members and wherein a portion of each roller extends above said base member to which it is attached, said second pairs having cushioning means attached to said second pair of rollers' external surface which supports said rolling door curtain, said rolling door curtain constructed from strips having a width less than their length, said strips being hingedly connected to one another, each of said second pairs of rollers having a diameter greater than the width of said rolling door curtain strips and being spaced apart a distance greater than the length of said rolling door curtain strips, and each roller in each of said second pairs being spaced apart from one another a distance less than the width of said rolling door curtain strips.

2. An apparatus according to claim 1 wherein said drive means comprise locking means to prevent said drive means from rotating said barrel assembly.

* * * * *